US009421693B2

(12) United States Patent
Baechtold et al.

(10) Patent No.: US 9,421,693 B2
(45) Date of Patent: Aug. 23, 2016

(54) METHOD FOR FORMING SHAPED LABEL STACKS

(71) Applicants: Georges Baechtold, Glattfelden (CH); René Amherd, Wollerau/SZ (CH)

(72) Inventors: Georges Baechtold, Glattfelden (CH); René Amherd, Wollerau/SZ (CH)

(73) Assignee: Blumer Maschinenbau AG, Otelfingen (CH)

( * ) Notice: Subject to any disclaimer, the term of this patent is extended or adjusted under 35 U.S.C. 154(b) by 78 days.

(21) Appl. No.: 14/086,281

(22) Filed: Nov. 21, 2013

(65) Prior Publication Data

US 2014/0165805 A1 Jun. 19, 2014

(30) Foreign Application Priority Data

Nov. 21, 2012 (CH) ..... 2470/12

(51) Int. Cl.

| | |
|---|---|
| ***B26F 1/14*** | (2006.01) |
| ***B26D 7/06*** | (2006.01) |
| ***B26F 1/40*** | (2006.01) |
| *B26D 11/00* | (2006.01) |

(52) U.S. Cl.

CPC ..... *B26F 1/14* (2013.01); *B26D 7/0675* (2013.01); *B26F 1/40* (2013.01); *B26D 2011/005* (2013.01); *B65H 2301/4224* (2013.01); *B65H 2301/4229* (2013.01); *Y10T 83/0505* (2015.04)

(58) Field of Classification Search

CPC ..... B26F 1/40; B26F 1/14; B26D 7/0675; B26D 2011/005; Y10T 83/0505; B65H 2301/4224; B65H 2301/4229

USPC ..... 83/23, 25; 101/2, 29

See application file for complete search history.

(56) References Cited

U.S. PATENT DOCUMENTS

| | | | | |
|---|---|---|---|---|
| 2,028,785 | A * | 1/1936 | Kleineberg | 83/446 |
| 2,376,470 | A * | 5/1945 | Youngchild | 83/91 |
| 2,528,888 | A * | 11/1950 | Klingens | 83/92 |
| 3,505,918 | A * | 4/1970 | Schneider | 83/112 |
| 3,938,435 | A * | 2/1976 | Suda et al. | 101/2 |
| 4,181,052 | A * | 1/1980 | Kopp | 83/79 |
| 4,405,186 | A * | 9/1983 | Sandberg et al. | 414/21 |
| 4,543,864 | A * | 10/1985 | Hochanadel et al. | 83/91 |
| 4,593,893 | A * | 6/1986 | Suter | 270/52.12 |
| 4,831,553 | A * | 5/1989 | Yoshino | 358/1.12 |
| 5,375,492 | A * | 12/1994 | Smitterberg et al. | 83/13 |
| 5,768,963 | A * | 6/1998 | Bruehwiler | 83/27 |
| 6,152,004 | A * | 11/2000 | Nispel | 83/92 |
| 8,616,101 | B2 * | 12/2013 | Neuland et al. | 83/86 |

(Continued)

FOREIGN PATENT DOCUMENTS

| | | |
|---|---|---|
| CH | 02470/12 | 11/2012 |
| DE | 40 13 071 A1 | 6/1991 |

(Continued)

*Primary Examiner* — Sean Michalski

(74) *Attorney, Agent, or Firm* — Pauley Erickson & Kottis

(57) ABSTRACT

A method for shortening the processing time on creating shaped label stacks. Between a strip pack cross-cutter and a die-cutting device in the region of a conveying section, the strip packs cut by way of the strip pack cross-cutter into stack packs are transferred and then die-cut in the die-cutting device into shaped label stacks. Two or more stack packs are layered on one another in the region of the conveying section and the layered stack packs are die-cut into shaped label stacks, for increasing the die-cutting output. The layered, die-cut stacks can then be divided again into shaped label stacks that can be managed and banded.

12 Claims, 2 Drawing Sheets

(56) References Cited

U.S. PATENT DOCUMENTS

| | | | | |
|---|---|---|---|---|
| 2005/0042323 | A1* | 2/2005 | Habisreitinger et al. | 425/472 |
| 2006/0263196 | A1* | 11/2006 | Kietzmann | 414/794 |
| 2008/0175702 | A1* | 7/2008 | Kietzmann | 414/788.1 |
| 2009/0038453 | A1* | 2/2009 | Malenke et al. | 83/23 |
| 2011/0259775 | A1* | 10/2011 | Bratter et al. | 206/449 |
| 2012/0040814 | A1* | 2/2012 | Liu | 493/342 |
| 2012/0099956 | A1* | 4/2012 | Diehr et al. | 414/728 |
| 2013/0061729 | A1* | 3/2013 | Reifenhaeuser | 83/26 |
| 2013/0152806 | A1* | 6/2013 | Quan et al. | 101/2 |
| 2013/0248100 | A1* | 9/2013 | Peruzzi et al. | 156/264 |

FOREIGN PATENT DOCUMENTS

| | | | | |
|---|---|---|---|---|
| DE | 10013417 | * | 9/2001 | B65G 57/20 |
| EP | 0 482 435 | A2 | 4/1992 | |
| EP | 2 228 182 | A1 | 9/2010 | |

* cited by examiner

METHOD FOR FORMING SHAPED LABEL STACKS

BACKGROUND OF THE INVENTION

1. Field of the Invention

This invention relates to a method for forming shaped label stack packs using a strip pack cross-cutter and a die-cutting device, between which a conveying section is present, wherein a multitude of printed strips which are pre-cut in strips from the sheet form a strip pack which is cut on the strip pack cross-cutter into stack packs and led to the die-cutting device, upon which the stack packs are die-cut into shaped label stack packs.

2. Discussion of Related Art

Parts of such an installation which are suitable for carrying out the method according to this invention are known from various documents. In their entirety, such installations on the market are also offered by the applicant. European Patent Reference EP 482435 shows a conveying section or transfer section and a subsequent die-cutting device which is additionally equipped with a banding station. The strip pack cross-cutter, not represented in the document, is practically arranged at the other end of the transfer section and is known for example from European Patent Reference EP 2228182.

Shaped labels are known in many shapes and sizes and are their application is widespread. One can find such labels on glass containers, such as beer bottles, yogurt cartons or oil bottles or also in the form of seals on beer bottles, cigarette packets or cigar bands and the like. Huge piece numbers are required for all these applications. Accordingly, insulations, as mentioned above, are known to manufacture such shaped labels. For this, the printed or Imprinted paper sheets with or without the printed-on shaped labels are manufactured by printing shops and in further processing shops are finished into completed, printed or non-printed labels or rectangular/square blanks. Finally, in the mentioned installations which mostly are of three or more working stations, the die-cut shaped labels are separated in a separating station into stacks of a defined number of labels/blanks, subsequently banded and provided in stack packs in a carton, tray or box. In the guillotine machine, the printed sheets manufactured in the printing shop are cut into strips, so that strip packs are present, and the strip packs are then cut off transversely to their longitudinal extension. A so-called stack pack arises if one cuts the strip sheet stack perpendicularly to its longitudinal direction. This stack pack is then displaced over a conveying section or transfer section to a die-cutter or to a die-cutting device and here each individual stack pack is die-cut into the final shape and subsequently a band is attached around this stack of shaped labels and this permits the further transport to the customers. These customers are companies which have filling installations or packaging installations and operate these for their own use or as a service for third parties.

The installations, on which the desired shaped label stack packs are formed, must likewise have a high output in accordance with the enormous piece numbers of such shaped labels. It is known that the reliability and service life of the individual parts must be as high as possible, in order to keep the times of standstill for overhauls as low as possible.

Basically, one could consider increasing the performance or output capability of such machines, by having the stack packs as high as possible, so that basically less cuts per unit of time need to be accomplished at the strip pack cross-cutter as well as at the die-cutting device. However, relatively strict limits are placed on this for two reasons. First, one cannot cut an infinitely high stack on the strip pack cross-cutter, without having to significantly strengthen or reinforce this strip pack cross-cutter. Second, printed and often plasticised shaped labels are relatively slippery and the shaped labels slip when cutting higher stack packs, even if these are held under a biasing pressure or pressure force. Third, there is yet a natural limit to the height of the stack packs, because these are packed away and in part are also admitted into the further processing installations, by hand. Thus, such a stack pack cannot be higher than can be rapidly and securely gripped by the hand, and thus should be shorter than a hand span. Today, stack packs of 12 cm height are common.

On the other hand however, a strip pack cross-cutter can cut more than one strip pack in one pass without any problem. If the strip pack cross-cutter cuts away for example 2 to 4 stack packs all at once from 2 to 4 strip packs lying next to one another, then the frequency of the stack packs arriving at the die-cutting machine thereby increases. The cycle speed of this is however limited.

SUMMARY OF THE INVENTION

In trials, the applicant has ascertained that with each die-cutting, the uppermost labels are slightly larger than the lowermost ones, depending on the applied substrate, on the applied inner and outer angle at the die-cutting tool, on the feed speed with the die-cutting procedure and further factors. Thereby, one speaks of an undercut, which is to be kept within defined limits. Given an insufficient stability of the die-cutting tool, the die-cutting tool with the die-cutting procedure can deform slightly and enter into a certain oscillation, by which in each case the cut of the stack is of a lower quality from the beginning, and the subsequent cut region with a calm knife is of a greater quality. Thus, one has ascertained that when increasing the frequency of the die-cutting device, the penetration speed which also increases as a consequence, leads to a greater deformation of the knife and the cutting quality thus reduces with an increasing operating frequency and subsequently the dwell time until the settling of the knife increases due to the increasingly occurring oscillations.

This results in the dilemma of the output performance of an installation for forming shaped label stack packs not able to be simply increased by way of forming more stack packs per time unit, but one would simultaneously have to succeed in the cycle time of the die-cutting device being able to be reduced.

As a result, it is one object of this invention, to provide a method, by way of which known installations for forming shaped label stack packs can have their output increased, without a significant cost increase of the known installation.

BRIEF DESCRIPTION OF THE DRAWINGS

This object and others are achieved by a method with the features taught in this specification and in the claims, and further advantageous embodiments of the method and their significance and manner of action are explained in the subsequent description with reference to the accompanying drawings. Four different embodiments of the method according to this invention are schematically represented in the drawing by way of example, wherein:

DETAILED DESCRIPTION OF INVENTION

Figure 1:
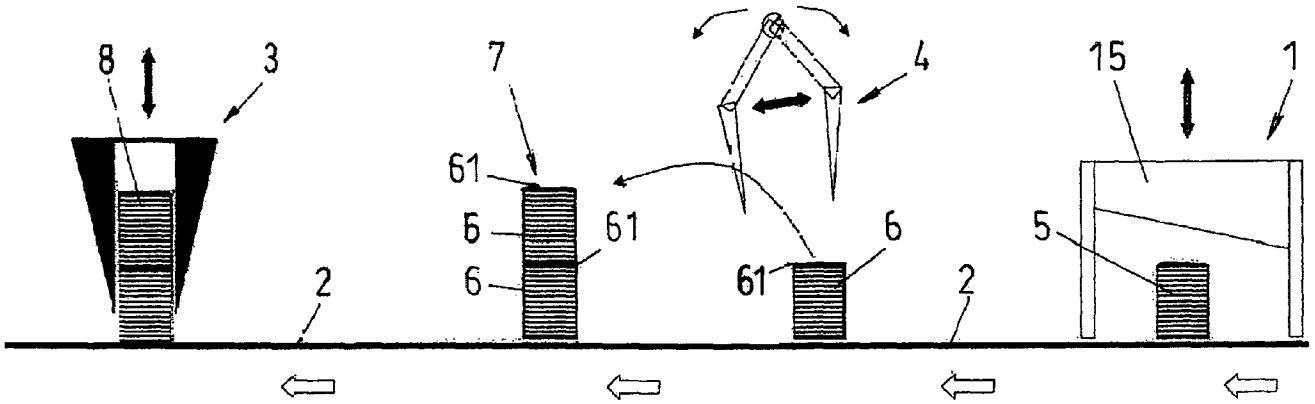
FIG. 1 shows a method, in which stack packs are cut individually, layered on one another and subsequently die-cut.

A first embodiment of the method according to this invention is shown in FIG. 1. The method takes its course from the right to the left in the drawing. Accordingly, at the far right the symbolically represented strip pack cross-cutter is indicated as element reference numeral 1. The transfer or conveying section 2 extends from the strip pack cross-cutter 1 up to the die-cutting device 3. A gripper 4 is symbolically represented between the strip pack cross-cutter 1 and the die-cutting device 3. The strip packs 5 cut from sheets are present at the strip packet cross-cutter 1. The strip pack 5 is represented with a view to the narrow face side. The knife 15 of the strip pack cross-cutter in a stepped manner separates pieces from this, according to the size of the shaped labels to be formed, and these cut away pieces are indicated as stack packs. The stack pack has the reference numeral 6. The transfer or conveying section 2 is shown in a level manner in the installation represented symbolically here. In reality however, an L-shaped channel rectangular in cross section and inclined by about 20-30 degrees, in which channel the strip packs 6 separated by the strip pack cross-cutter 5 are deposited and transported. This transport can basically be effected by way of suitable sliders or by way of other conveying means, such as conveyor belts for example.

In the first embodiment of the method according to this invention, by way of the strip pack cross-cutter 1, only one individual strip pack is fed and accordingly the separated stack packs 6 are transported further also only individually. The transport is thereby preferably effected in a stepped manner. Thus, a series of stack packs 6 forms and in this embodiment a gripper 4 is located above the conveying or transfer section 2. This gripper 4 now grips a stack pack 6 and now applies this onto a stack pack 6 which has already been previously conveyed, so that a layered stack 7 now arises. In the example represented here, this layered stack 7 has two stack packs 6. The layered stack 7 is then led to the die-cutting device 3 and brought into the end shape.

In the embodiment which is represented here, each stack pack 6 is provided in each case with a separating layer 61 at the very top or the very bottom and this separating layer serves for bringing the shaped labels die-cut into their end shape back into a shaped label stack which is as equally large as the original stack packs 6. These shaped label stacks are then provided with a band by way of a banding device which is not shown here, and these banded shaped labels stacks then go to a gluing station of foiling or packaging installation.

Basically, the stack packs 6 which are formed by way of the strip pack cross-cutter 1 could be moved continuously to the die-cutting device 3. However, it makes more sense to do this in a cycled manner. Thus, one can advance the strip pack 5, move the knife downwards and deposit a stack pack 6 into the conveying section 2 during the standstill time. During the same time, the gripper 4 can now grip a stack pack which is already on the conveying section 2 at a position remote from the strip pack cross-cutter 1 and this can be layered onto a stack pack 6 which is yet more remote from the strip pack cross-cutter. During the same time, the die-cutting device 3 can die-cut the layered stack packs advanced yet further, into shaped labels 8, as shown in FIG. 1 in the position shown at the far left. This cycled advance can be realised with little technical effort, but a continuous advance would indeed also be possible.

Figure 2:
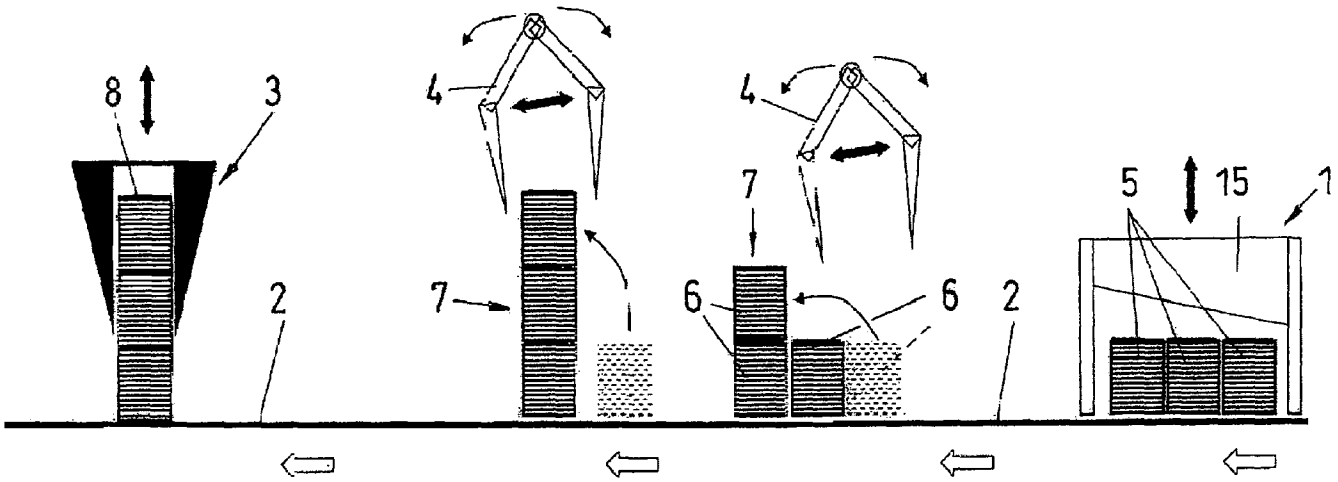
FIG. 2 shows one embodiment in which several stack packs are simultaneously cut, again layered on one another and die-cut.
Figure 3:
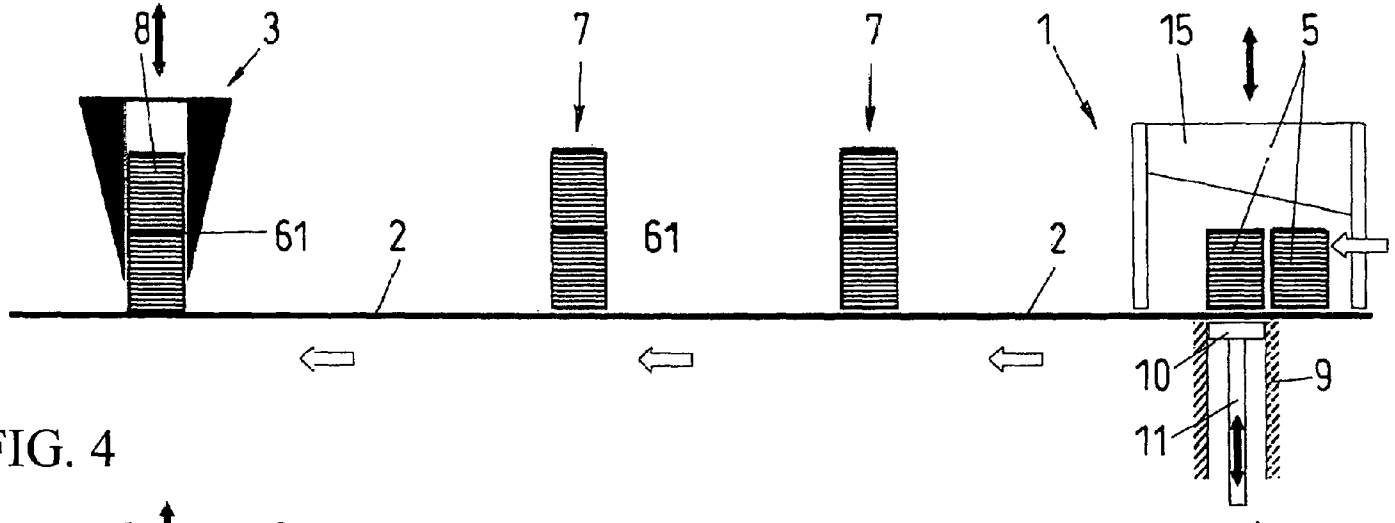
FIG. 3 shows a solution, with which the layering of the stack packs is effected in a shaft close to the guillotine.
Figure 4:
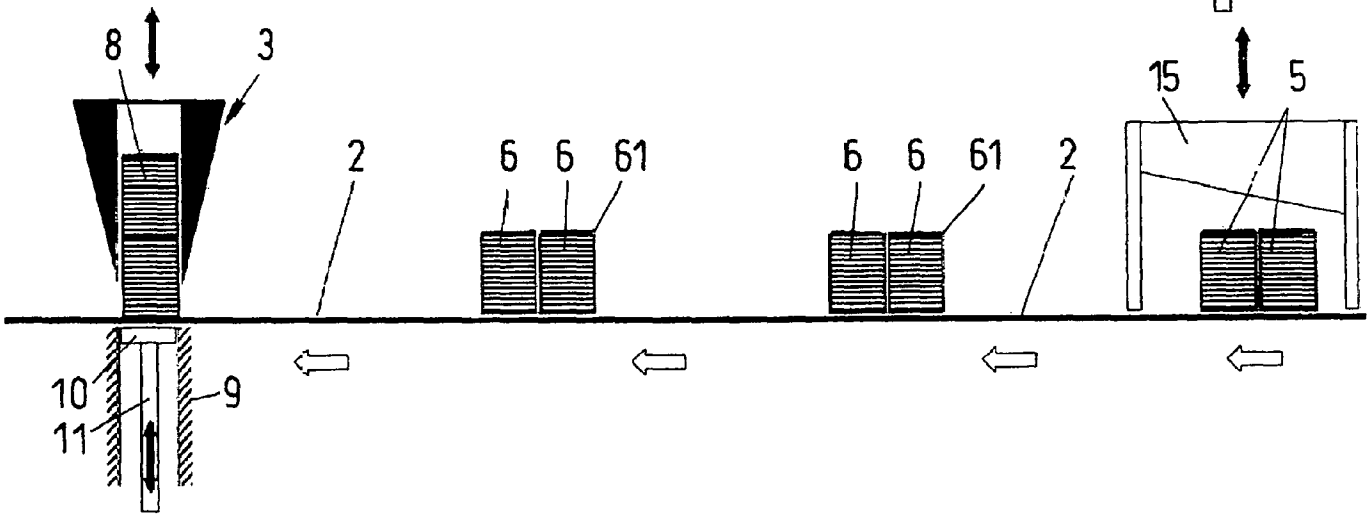
FIG. 4 shows a solution, in which the shaft for stack pack layering is part of the die-cutting device.

In another embodiment of the method according to this invention, the strip pack cross-cutter 1 cuts at least two strip packs in one pass or go, and these strip packs 6 lying next to one another are subsequently layered into a layered stack 7. Such an embodiment is represented in FIG. 3. In this case, the two strip packs lying directly next to one another could be transported further on the conveying section 2 and subsequently be applied onto one another into a layered stack 7 as shown in FIG. 2.

Basically, practically several strip packs 5 can be simultaneously cut by way of the strip pack cross-cutter 1 and in one or several successive steps can be formed into a layered stack 7 by way of one or more grippers 4. Such a solution is shown in FIG. 2.

In particular, if several such stack packs 6 have been formed into a layered stack 7, it makes sense to provide the individual stack packs with a separating layer 61 at the very top and at the very bottom. In this manner, again stack packs of die-cut labels can be formed after the layered stack 7 has been die-cut into a shaped label stack pack 8, and these labels can subsequently be banded as is known.

Basically, the layered stacks 7 can be formed from several stack packs 6 in the most different of manners. Apart from the already mentioned variant by way of grippers, it is also possible to form the layered stack such that a lowerable base 10 is provided at any location of the conveying section 2, and this base, as soon as a first stack pack 6 has been deposited thereon in a lying manner, is lowered by way of a lift device 11. A second stack pack is pushed over the now lowered first stack pack 6, and the thus formed layered stack 7 on the lowerable base 10 is lifted by the lift device 11 back up to the initial level. As previously described, the layered stack is advanced in a cycled manner up to the die-cutting device 3.

Basically, a shaft 9 is necessary for this, in which the stack pack 6 and the lowerable base 10 can be led in an exact manner.

Such a shaft 9 with a lowerable base 10 and lift means 11 in principle can be attached at any location of the conveying section 2.

However, two such embodiments are preferred. A first one is shown in FIG. 3 and here the guidance of the strip packs 5 is arranged such that a first cut-away stack pack 6 comes to lie directly on the lowerable base 10. As soon as this first stack pack 6 lies on this lowerable base in a completely separated manner, the lift device 11 is actuated and the second separated stack pack is displaced directly over the shaft 9, whereupon then the thus layered stack 8 can be lifted and transported further.

A second preferred arrangement lies in arranging the shaft 9 in a directly aligned manner below the die-cutting device 3. The lowerable base 10 and thus the lift device 11 as the case may be thus assume a second function. On one hand, it is possible to lift the layered stack and then in thus upper position to move the shaping knife of the die-cutting device 3 downwards up to the lowerable base 10. However, it is also possible to leave the layered stack 8 in the shaft 9, to lower the die-cutting knife of the die-cutting device 3 to the level of the conveying section 2 and then to move the lift device 11 upwards and thereby to lift the layered stack 7 and press the layered stack 7 through the die-cutting knife of the die-cutting device 3.

The method according to this invention lies in cutting strip packs either individually or several with one another, into stack packs, bringing two or more stack packs onto one another and then die-cutting these layered stack packs in a single die-cutting movement, into a shaped label stack pack. Optionally, this stack can again be divided into smaller stack packs and these stack packs of shaped labels likewise optionally banded. In most cases however, one would almost always carry out this division and also almost always subsequently carry out the banding. As the case may be, one may make do without the formation of new stack packs of shaped labels, only where this method is arranged directly in front of a filling or packaging station and the shaped labels can be led directly to a gluing station. The normal case however would be this method according to this invention carried out independently and remotely from a filling and packaging installation. This also makes sense because such an installation can now achieve a significantly higher output than a filling installation can accommodate shaped labels.

Apart for the already described possibilities two forming two or more stack packs into a layered stack, there is also a possibility of tilting these stack packs by 90° and pushing together these tilted stack packs until the desired height of a layered stack 7 and then rotating this layered stack back again by 90°, so that a standing stack arises. It would also be possible to displace this layered stack 7 tilted by 90° directly to the die-cutting device, wherein then the die-cutting device would have to be attached practically aligned to the conveying section.

A further embodiment of forming the layer stack can also be to provide the conveying section with a diverter which is to say points, and the stack packs being distributed here on two conveying sections, which are then led together over one another, and thus forming the stack packs.

Yet further possibilities of forming layered stack packs are possible.

Swiss Patent Reference CH 02470/12, filed 21 Nov. 2012, the priority document corresponding to this invention, to which a foreign priority benefit is claimed under Title 35, United States Code, Section 119, and its entire teachings are incorporated, by reference, into this specification.

What is claimed is:

1. A method for forming shaped label stacks using a strip pack cross-cutter (1) and a die-cutting device (3), between which is a conveying section (2), wherein a plurality of sheets cut into strip packs (5) is present and the strip packs (5) are cut into stack packs (6) and led to the die-cutting device (3), the stack packs (6) being die-cut into shaped label stacks (8), the method comprising two or more of the stack packs (6) moved relative to one another so that a plurality of the stack packs (6, 7) layered on one another are led to the die-cutting device (3), whereupon the stack packs are die-cut into shaped label stacks (8), wherein the strip packs (5) at a top and at a bottom are provided with a separating layer which is co-cut and is co-die-cut with the layered stack packs (7) in the die-cutter, in order thereafter to separate the shaped label stack (8) again into stacks as equally high as the initial stack packs (6), and to bundle them with a band.

2. The method according to claim 1, wherein only one strip pack (5) is cut at a time into a stack pack (6) by the strip pack cross-cutter (1), the cut stack pack (6) is conveyed and a next stack pack (6) is thereafter cut, and then the next stack pack (6) is conveyed at a distance behind the cut stack pack (6), and at least two consecutive stack packs (6) are layered (7).

3. The method according to claim 1, wherein at least two strip packs (5) are cut at a same time with the strip pack cross-cutter (1) into stack packs (6) and subsequently layered (7).

4. The method according to claim 1, wherein a stack pack (6) is gripped (4) and is applied onto an adjacent stack pack (6) or onto two or more already layered stack packs (7).

5. A method for forming shaped label stacks using a strip pack cross-cutter (1) and a die-cutting device (3), between which is a conveying section (2), wherein a plurality of sheets cut into strip packs (5) is present and the strip packs (5) are cut into stack packs (6) and led to the die-cutting device (3), the stack packs (6) being die-cut into shaped label stacks (8), the method comprising two or more of the stack packs (6) moved relative to one another so that a plurality of the stack packs (6, 7) layered on one another are die-cut into shaped label stacks (8) by the die-cutting device (3), wherein a shaft is arranged in the transfer section (2) and is with a lowerable base which is lowered in the cycle of the arriving stack packs (6) and by a height of these, and a further stack pack (6) is pushed in each case over one or more already lowered stack packs (6), and the lowerable base after reaching a desired quantity of layered stack packs (7) is lifted up to the level of the conveying section (2).

6. The method according to claim 5, wherein the lifted layered stack packs (7) are conveyed to the die-cutter.

7. The method according to claim 5, wherein the shaft with the lowerable base is arranged such that the stack pack (6) which is the frontmost in the conveying direction comes to lie directly on the lowerable base on cutting.

8. The method according to claim 5, wherein the shaft with the lowerable base is attached directly at the die-cutter, and the base presses the layered stack packs (7) directly into the cutting die of the die-cutter, and the base serves as a counter die-cutting plate.

9. The method according to claim 5, wherein the shaft with the lowerable base is attached directly at the die-cutter, and the base presses the layered stack packs (7) directly into the cutting die of the die-cutter, and the base serves as a counter die-cutting plate.

10. A method for forming shaped label stacks using a strip pack cross-cutter (1) and a die-cutting device (3), between which is a conveying section (2), wherein a plurality of sheets cut into strip packs (5) is present and the strip packs (5) are cut into stack packs (6) and led to the die-cutting device (3), the stack packs (6) being die-cut into shaped label stacks (8), the method comprising two or more of the stack packs (6) moved relative to one another so that a plurality of the stack packs (6, 7) layered on one another are led to the die-cutting device (3), whereupon the stack packs are die-cut into shaped label stacks (8), wherein the cut stack packs (6) on the conveying section (2) are separated by at least one diverter, and one of the stack packs (6) is led on a second conveying section (2) so that it is displaced or deposited over another stack pack (6) or several already layered stack packs (7).

11. The method according to claim 5, wherein the strip packs (5) at a top and at a bottom are provided with a separating layer which is co-cut and is co-die-cut with the layered stack packs (7) in the die-cutter, in order thereafter to separate the shaped label stack (8) again into stacks as equally high as the initial stack packs (6), and to bundle them with a band.

12. The method according to claim 5, wherein the shaft with the lowerable base is arranged such that the stack pack (6) which is the frontmost in the conveying direction comes to lie directly on the lowerable base for cutting.

* * * * *